United States Patent [19]

Hour

[11] Patent Number: 4,986,476

[45] Date of Patent: Jan. 22, 1991

[54] CLEANING SPRAYERS WITH A SPRAYING-ANGLE ADJUSTING DEVICE

[76] Inventor: Tyh-Yuan Hour, 82, To-Syh Village, Luh-Jeau Shian, Chiayi Hsien, Taiwan

[21] Appl. No.: 396,661

[22] Filed: Aug. 22, 1989

[51] Int. Cl.[5] ..... B05B 3/02

[52] U.S. Cl. ..... 239/227; 239/247; 239/263.3; 239/265; 134/167 R; 134/181

[58] Field of Search ..... 239/227, 246, 263.1, 239/264, 265, 247, 263.3; 134/167 R, 181

[56] References Cited

U.S. PATENT DOCUMENTS

| | | | |
|---|---|---|---|
| 3,994,310 | 11/1976 | Brandon | 239/246 |
| 4,013,222 | 3/1977 | Travaglio | 239/227 |
| 4,073,438 | 2/1978 | Meyer | 239/227 |
| 4,474,328 | 10/1984 | Hale | 239/227 |
| 4,671,462 | 6/1987 | Badria | 239/227 |

*Primary Examiner*—Andres Kashnikow
*Assistant Examiner*—Karen B. Merritt
*Attorney, Agent, or Firm*—Larson & Taylor

[57] ABSTRACT

A cleaning sprayer with a spraying-angle adjusting device comprises a spray nozzle base possible to be turned horizontally or to be tilted, or to be turned upside down by adjustment so that two spray nozzles provided on said spray nozzle base can have a wide scope of spraying angle.

5 Claims, 6 Drawing Sheets

CLEANING SPRAYERS WITH A SPRAYING-ANGLE ADJUSTING DEVICE

BACKGROUND OF THE INVENTION

Cleaning sprayers are widely used for cleaning stables for horses, cows, or pigs, etc. Generally they are provided with an automatic spraying device to provide for periodical cleaning or sterilization. But conventional sprayers can spray only in the preset direction, and are unadjustable in the spraying angles thereof to reach the high roofs or corners.

SUMMARY OF THE INVENTION

In order to solve the problems in the art mentioned above, the present invention has been worked out to provide cleaning sprayers with a spraying-angle adjusting device.

This cleaning sprayer with a spraying-angle adjusting device in accordance with the present invention comprises a base like a round case with a cap. The case has a stabilizing pipe firmly fixed thereto and extending out from the side wall by means of a stabilizing bolt and a nut. A water pipe connector pipe is set through the side wall opposite to the stabilizing bolt. A motor base set in the interior is linked with a 90° elbow fitting. This fitting has its outlet joined and communicating with a guide set at the center of a large gear wheel and its inlet joined and communicating with the water pipe connector. The outlet of the guide pipe is joined and communicating with a spray nozzle base. The nozzle base is provided with two spray nozzles, one set horizontal and the other set inclinedly upward. Water runs in through the water pipe connector, the 90° elbow fitting, the guide pipe, the spray nozzle base and finally runs out of the two spray nozzles. In addition, the large gear wheel can rotate from 360° owing to its engaging with a gear formed at the top of the shaft of the motor base mentioned above. Thereby the spray nozzle base along with the large gear wheel rotate at the same time for 360° horizontally during the movement of the motor.

In addition, two long bolts are provided alignedly opposite one another and screwing from outside through oppositely the wall of the base pinch or leave a space for the linking bar. The linking bar is linked with the motor base by means of its inner ends so that the spray nozzle base rotates only horizontally, or inclines to one side (the handle side). The base can be inverted so that the spray nozzle base rotates upside down with the central axis of the base as a pivot. As a result, the scope of spraying angle of said nozzle can be changed in various ways.

BRIEF DESCRIPTION OF THE DRAWINGS

This invention will now be described in detail with reference to accompanying drawings wherein.

DETAILED DESCRIPTION OF THE INVENTION

Figure 1:
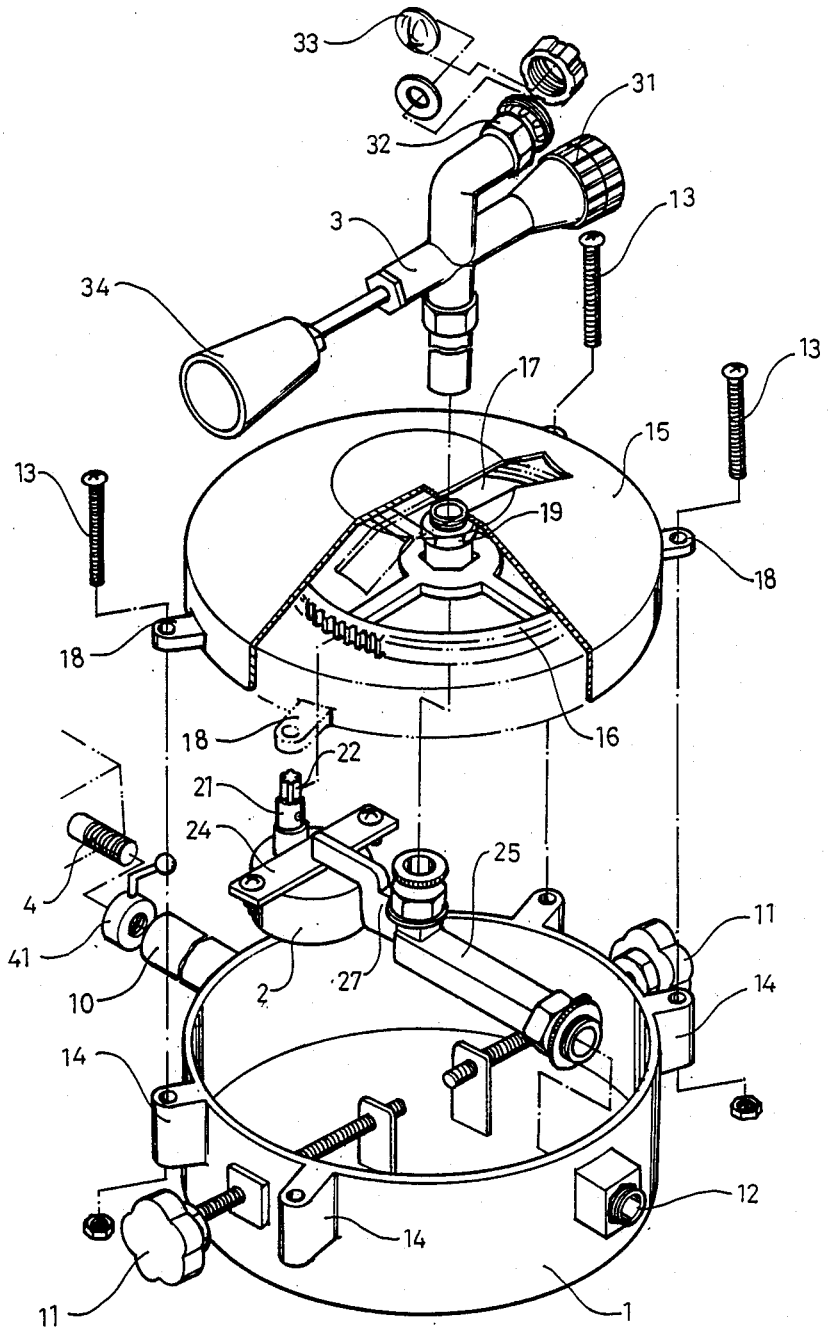
FIG. 1 is an exploded perspective view of the cleaning sprayer with a spraying-angle adjusting device in accordance with the present invention.

This invention, as FIG. 1 shows, comprises a base 1 shaped as a round case with a cap for mounting the rest of the parts thereon. A pair of opposed bolts 11 is provided penetrating from outside through respective threaded holes in the wall of the base. It is thus possible to adjust the extending length of bolts 11 in the base 1, in other words, one is able to change the gap between their inner ends and a linking bar 27 linked with a motor base 2. The base 1 is also provided with a water pipe connector 12 through the side wall to join with a nut and a nozzle (not shown) for recieving water coming therein.

Next, a motor base 2 is mounted in the interior of the base 1, and is provided with a shaft 21 having a gear 22 formed at its top end. Gear 22 engages with a large gear wheel 16, which can then be rotated by said gear 22 turned by the motor. A round cap 15 is provided with a straight opening 17 going parallel to the bolts 11. Round cap 15 is also provided with holed ears 18 for bolts 13 to go through for combining together the cap 15 with the base 1, which has holed ears 14 in the corresponding positions with those holed ears 18 in the cap 15 for the bolts 13 pass through and suitable nuts to screw with. The motor base 2 is welded with a 90° elbow fitting 25 by means of a flat plate 24 and the linking bar perpendicular to said plate 24. The elbow fitting 25 has its inlet joined and communicating with the water pipe connector 12 and its outlet with a guide pipe 19. Guide pipe 19 is set through the center of the larger gear wheel 16 and then joined and communicating with a spray nozzle base 3. The linking bar 27 linking the motor base 2 and the elbow fitting 25 can be pinched and hence rendered immovable by the inner ends of the two bolts 11 if said bolts 11 are inwardly turned, and thereby the spray nozzle base 3 can be also kept immovable. On the other hand, if said bolts 11 are not turned inward enough to pinch the linking bar 27 between their ends, the base 3 is not kept immovable and instead inclines with its own center of gravity to the handle or grip 34 side of opening 17. The inclining angle of the base 3 depends on the width of the gap between the inner ends of the bolts 11 and the linking bar 27.

The spray nozzle base 3 joined and communicating with the guide pipe 19 protruding through the straight opening 17 in the cap 15 is provided with a horizontal nozzle 31 and an inclined nozzle 32, respectively for shooting out water in the horizontal direction and in the inclined upward direction in a wide angle. The nozzle 32 is provided with an adjuster 33 to change the spray direction. The spray nozzle base 3 is also provided with a grip 34 extending backward so that the spray nozzle base 3 is always under a force to incline backward.

Figure 2:
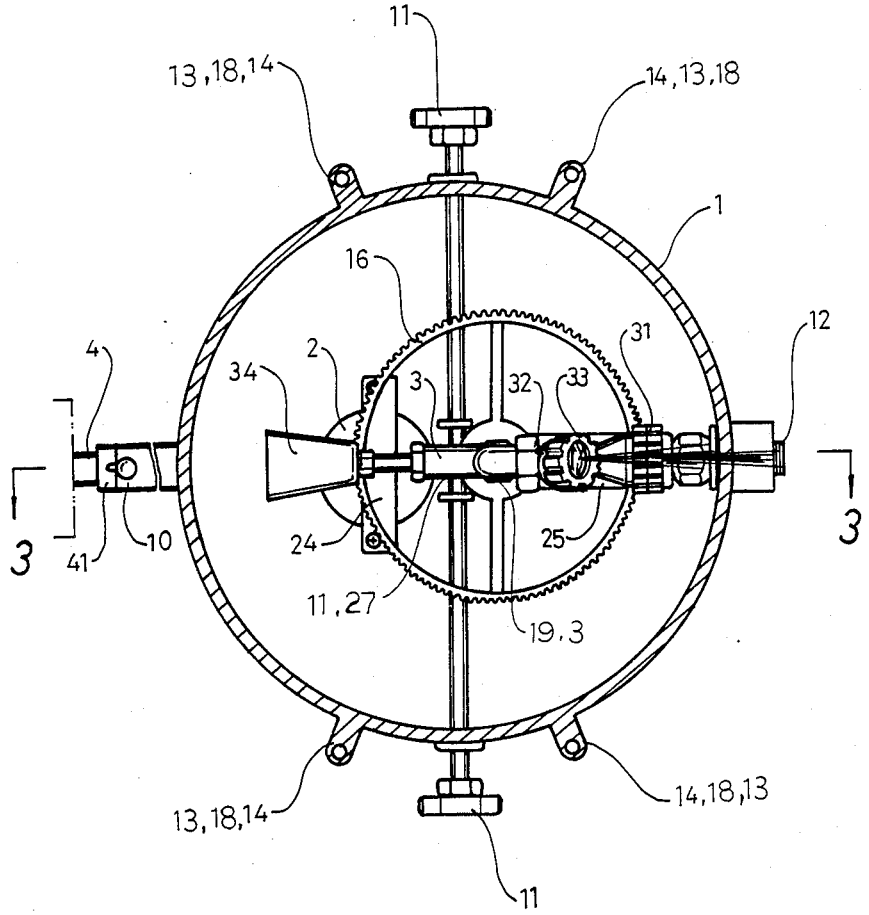
FIG. 2 is a cross-sectional top view of the first adjustment of the cleaning sprayer with a spraying-angle adjusting device in accordance with the present invention.
Figure 3:
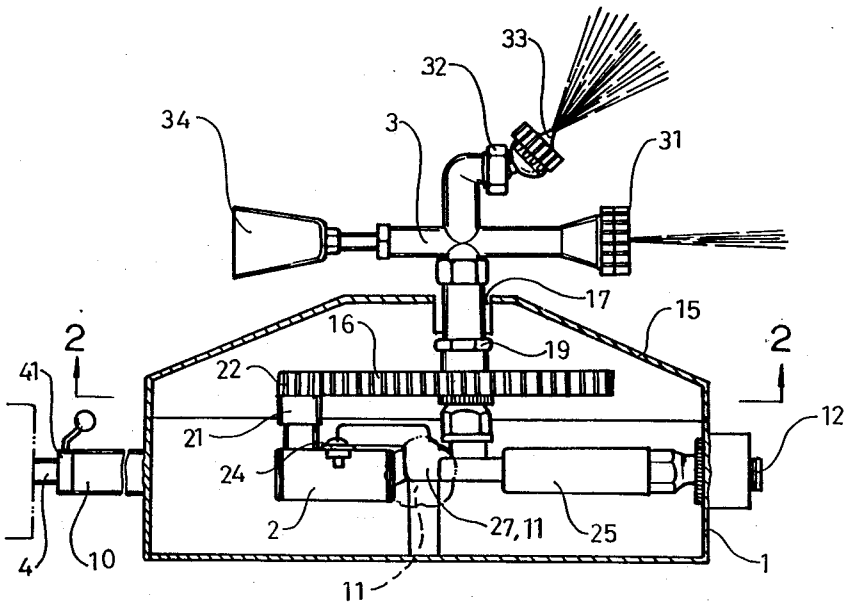
FIG. 3 is a cross-sectional front view of the first adjustment of the cleaning sprayer with a spraying-angle adjusting device in accordance with the present invention.

Referring to FIGS. 2 and 3, water is first made to flow through the water pipe conductor 12 and is finally sprayed out of the nozzles 31 and 32 simultaneously. Said nozzles 31 and 32 are steadfastly mounted on the gear wheel 16 as the spray nozzle base 3 is joined with the guide pipe 19 which is fixed through the center of the gear wheel 16. Thus the nozzles 31 and 32 along with the base 3 rotate for 360° while water is being sprayed thereout, because of the rotation of the gear wheel 16 on which said nozzles 31 and 32 and the spray nozzles base 3 are mounted. But it must be noted that the two bolts 11 are adjusted to have their inner ends pinching the linking bar. Thus if the bolts 11 are adjusted to have a gap between their inner ends and the linking bar 27, the width of the gap between the inner ends of the bolts 11 and the linking bar 27 can be utilized for adjusting the scope of the spraying angle for the nozzles 31 and 32.

Figure 4:
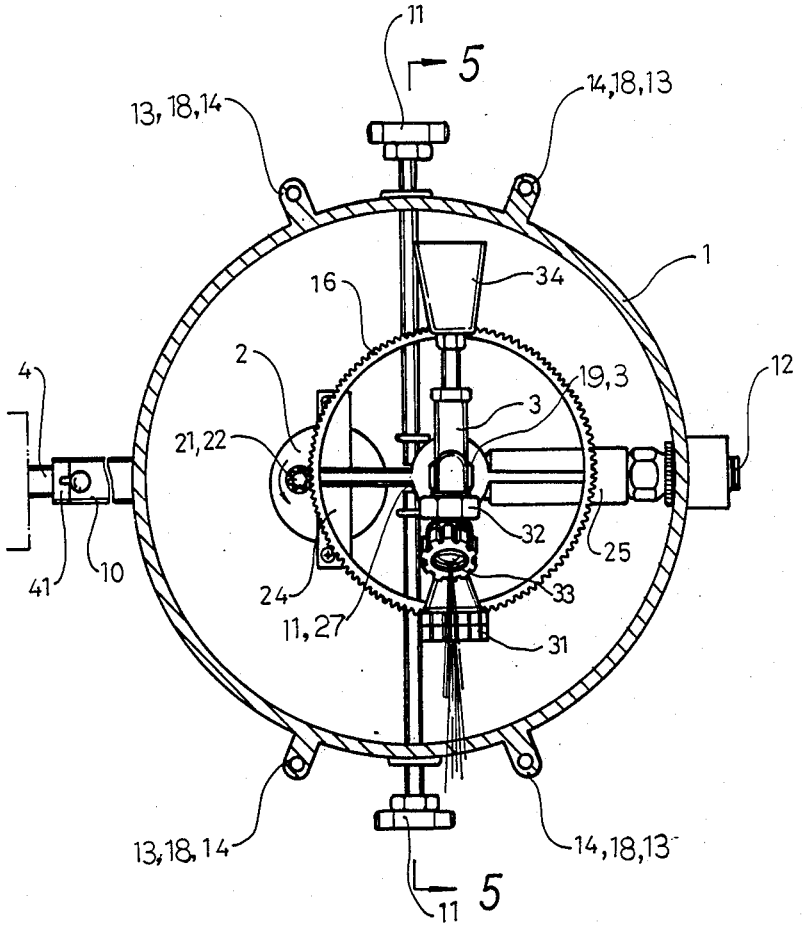
FIG. 4 is a cross-sectional top view of the second adjustment of the cleaning sprayer with a spraying-angle adjusting device in accordance with the present invention.
Figure 5:
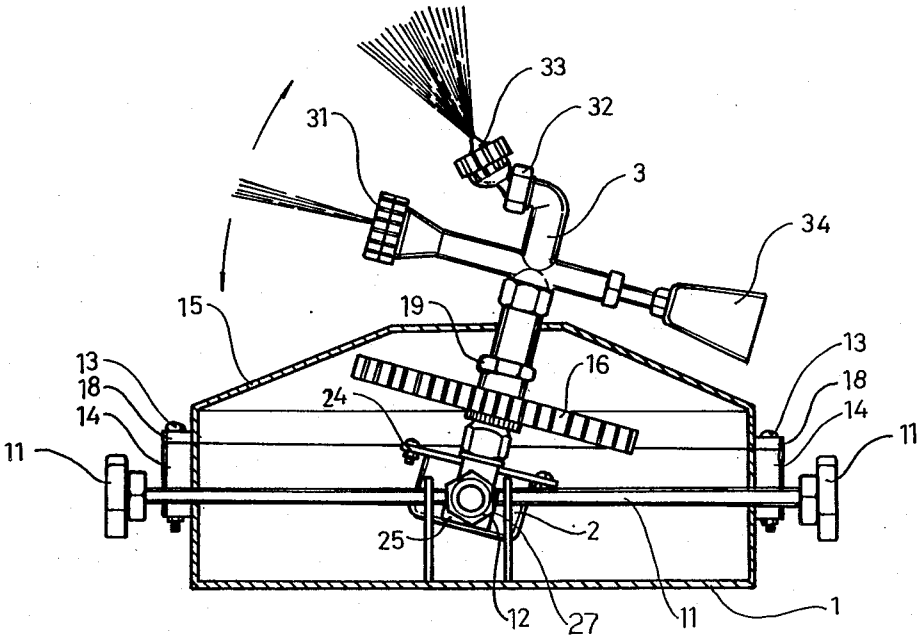
FIG. 5 is a cross-sectional front view of the second adjustment of the cleaning sprayer with a spraying-angle adjusting device in accordance with the present invention.

As FIG. 4 shows, when the spray nozzles 31 and 32 rotate to come to a place where they become overcross (i.e. more than 90°) to the water pipe connector 12, the linking bar 27 linked with the motor base 2 can (again) rotate with the water pipe connector 12 as an axis. This is caused by an upward inclining force of the water being sprayed out and by the inclining force of the spray nozzle base 3. Thus the motor base 2 along with the linking bar 27 or oscillate rightward from leftward so that the spraying angle of the spray nozzles 31 and 32 can become more widely upward as shown in FIG. 5. Then it is suitable for cleaning a high roof, and the scope of the spraying angle is adjustable by changing the gap between the inner ends of the two bolts 11 and the linking bar 27. The larger the gap is, the wider the scope is, or vice versa.

Figure 6:
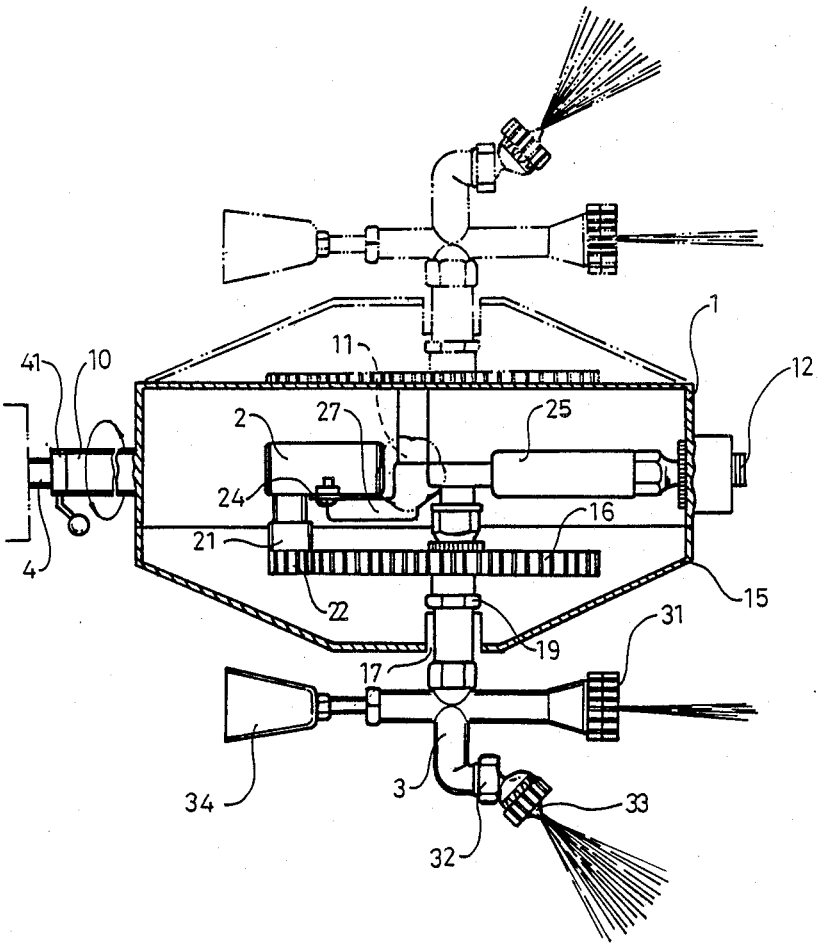
FIG. 6 is a cross-sectional front view of the third adjustment of the cleaning sprayer with a spraying-angle adjusting device in accordance with the present invention.

Now, FIG. 6 shows the base 1 adjustable to face upward (chained lines), or downward for spraying. This adjustment can be effected by a stabilizing bolt 4 received in a stabilizing pipe 10 and a nut 41, which can tighten the stabilizing bolt 4.

In general, this cleaning sprayer with a spraying angle adjusting device can not only spray horizontally or inclinedly for 360° but also for a wide scope of upward direction or downward direction to reach the roof of the floor.

What is claimed is:

1. A cleaning sprayer with a variable spraying-angle for cleaning water ejected therefrom comprising:

an enclosed base including (a) a sidewall means for enclosing a side thereof, in which said sidewall means a pair of threaded openings 180° opposite one another around said sidewall means are provided, and (b) a top in which an opening is provided;

a pair of threaded bolts, each said bolt being received in a respective said threaded opening and being directed so that an inner end thereof is adjustably spaced from and opposite an inner end of the other said bolt;

a water pipe connector provided in said sidewall means of said base which is displaced 90° around said sidewall means from said threaded openings;

a 90° elbow fitting in said base which is rotatably connected at an inlet end thereof defining a first axis to said water pipe connector and which includes an outlet end defining a second axis perpendicular to the first axis;

a motor means for rotating a drive gear;

a linking bar which is attached at one end to said motor means to mount said motor means thereto and which is mounted at another end to said 90° elbow fitting, said linking bar being laterally disposed between the inner ends of said bolts;

a guide having an outlet end and an inlet end, which said inlet end is rotatably connected to the outlet end of said 90° elbow fitting;

a gear wheel fixed about said guide pipe which engages said drive gear of said motor means so as to rotate said guide pipe about the second axis of said 90° elbow fitting;

a spraying means for spraying cleaning water, said spraying means extending through said opening in said top and including an inlet end which is secured to the outlet end of said guide pipe, two spray nozzles located outside of said base adjacent said opening of said top, and a mounting means for mounting one of said spray nozzles to said spraying means so that a spraying angle thereof is selectively adjustable;

whereby, as water is fed through said water pipe connector and ultimately out of said spray nozzles, said motor means causes said gear and hence said spray nozzles mounted to said guide pipe to rotate about the second axis of said 90° elbow fitting extending through said guide pipe, and further whereby ejection of the water from the spray nozzles causes said guide pipe and hence said spray nozzles to be inclined about the first axis of the 90° elbow fitting along the opening in said top in a direction of a resultant jet of said spray nozzles which direction reverses every 180° of rotation about said second axis as the resultant jet action reverses and with the amount of inclination determined by a clearance provided between the inner ends of said bolts and said linking bar.

2. A cleaning sprayer as claimed in claim 1 wherein said top is a removable cap, and wherein said base further includes a mounting means for mounting said cap to said sidewall means.

3. A cleaning sprayer as claimed in claim 2 wherein said enclosed base includes a circular bottom, said sidewall means is a circular sidewall upstanding from said bottom, and said cap is circular.

4. A cleaning sprayer as claimed in claim 1 and further including a stabilizing pipe extending outward from said sidewall means of said base, said stabilizing pipe being located 180° opposite said water pipe connection around said sidewall means such that said stabilizing pipe is engageable to help mount said cleaning sprayer in place.

5. A cleaning sprayer as claimed in claim 1 wherein said sprayer nozzles are both mounted on one lateral side of said spraying means, and said spraying means further includes a grip connected to an opposite lateral side of spraying means from said one lateral side such that said grip biases a center of gravity of said spraying means toward said grip.

* * * * *